United States Patent [19]

Nishikawa et al.

[11] 4,156,443

[45] May 29, 1979

[54] BINDING LACE FOR AN AUTOMATIC BINDER

[75] Inventors: Mitsuo Nishikawa; Hideo Hosaka; Jun Maemori, all of Takasaki, Japan

[73] Assignee: Max Co., Ltd., Tokyo, Japan

[21] Appl. No.: 826,519

[22] Filed: Aug. 22, 1977

[30] Foreign Application Priority Data

Aug. 24, 1976 [JP] Japan ..... 51/112496[U]
Jan. 29, 1977 [JP] Japan ..... 52/9774[U]

[51] Int. Cl.[2] ..... B21F 9/02

[52] U.S. Cl. ..... 140/101; 100/26; 428/373

[58] Field of Search ..... 140/93 A, 93.2, 93.6, 140/101; 100/26, 32 PB; 428/373

[56] References Cited

U.S. PATENT DOCUMENTS 3,057,648 10/1962 Schwarze et al. ..... 100/26
3,760,046 9/1973 Schwartz et al. ..... 428/373

*Primary Examiner*—Lowell A. Larson

[57] ABSTRACT

A binding lace for a novel automatic binder developed by the present inventors is disclosed. The binding lace is continuously thrusted from only one side of the binding lace into a lace guide positioned around an object to be bound and then travels while sliding along the lace guide without buckling to form loops of several turns overlapping each other. During travelling, the binding lace is sent in the lace guide without standing still, due to the properties of an outer portion and a core portion of the binding lace, while the binding lace always expands elastically outwardly in radial direction of the lace guide due to the larger rigidity and tensile stress of the core portion to hold a looped configuration with the loops having substantially the same diameter as the lace guide. After travelling stops, the binding lace is capable of holding the same diameter of the loops and a tip portion of the binding lace is held in the neighborhood of the overlap of the loops. The binding lace is pulled back to wind around the material to be bound. It has sufficient friction and elasticity in the outer portion of the binding lace, so that the tip portion of the binding lace is held by the bound material and at least one loop of the lace. In addition, the binding lace exerts a large tightening force by the core portion thereof, sufficient for binding a bundle of electric wires and gives a stable binding condition for a long time due to the outer portion thereof.

7 Claims, 22 Drawing Figures

BINDING LACE FOR AN AUTOMATIC BINDER

BACKGROUND OF THE INVENTION

This invention relates to a binding lace for use in binding a material to be bound, and more particularly to a cable harness by means of an automatic binder developed by the present inventors.

Hitherto, cable harnesses are widely used for electric connections, for instance in electric equipment, in automatic telephone switchboards, air planes, or automobiles. At the present times, these cable harnesses are manually prepared by using fine fibers or nylon laces. In other words, a lace is wound around a group of cables at least two turns, and then tightened fast to form a knot by pulling the opposite free ends of the lace. In this respect, such binding or tightening operation requires a force of over 5 to 10 kg, so that the hands of an operator are sometimes injured and in addition there results a large range of differences in the condition of the lace thus bound, with the accompanying shortcoming of poor operational efficiency. In order to avoid these shortcomings, there has been proposed a binding or tightening tool which tightens around a material to be bound a plastic band having tightening ring portions at its opposite ends. More particularly, the plastic band is wound around the material one turn, and then, the tightening ring portions, through which the ends of the band are passed, are tightened together by means of a tightening tool by a given tightening force. This type tool is a partial success in improving the operational efficiency and consistent quality of bound portions or knots, but the plastic bands are costly, so that in case binding portions are tremendously large in number, an increase in expense is no longer negligible and presents a critical economical problem, unlike the less expensive use of the prior art fine fiber, nylon lace and the like.

For binding a material to be bound with a binding lace for cable harnesses by an automatic binder, the binding lace should be at least required to meet the following criteria.

First, the binding lace should be capable of running stably along guide channels of a lace guide while it is sent into the lace guide by means of a feed-in mechanism.

Secondly, the binding lace should be capable of holding the condition in which it is guided along the guide channels to form a loop around the bound material.

Thirdly, the binding lace should be capable of being tightened with ease around the bound material and the loops formed therewith should be concentrated in a narrow range.

Fourthly, the binding lace should be capable of holding stably the opposite ends thereof between loop portions and provide a reliable binding.

However, since binding laces which are well known are circular in cross section and have smooth surfaces since they are produced by extrusion, the binding surfaces slip with respect to each other to decrease rapidly the tightening force in binding a bounded material.

Further, an elastic force which could change the diameter of a binding lace is not given to the binding lace, so that a looseness of a knot cannot be avoided. To avoid the above looseness after binding, binding laces which are provided with a rough surface are proposed. These binding laces however are not capable of elastic recovery when the tightening force is added to the binding laces to avoid looseness after binding.

On the other hand, a vinyl chloride lace has not given a strong tension and a nylon lace has given a strong tension, but has easily slipped and loosened.

SUMMARY OF INVENTION

The present invention provides a novel automatic binder for use in binding operations, particularly in binding cable harnesses. The automatic binder is capable of performing binding operations more efficiently than the prior art and at less cost.

The primary object of the present invention is to provide a novel binding lace which is provided with a novel property and structure having an excellent effect in binding a material, particularly a group of cables with the above automatic binder.

The other object of the present invention is to provide a novel binding lace which is capable of an accurate and rapid winding operation around a material, in case a material is bound with a binding lace by an automatic binder having a lace guide positioned around the material.

Another object of the present invention is to provide a novel binding lace which is capable of an easy and accurate tightened operation to stabilize a tightening condition.

Still another object of the present invention is to provide a novel binding lace best for use in case the lace is wound around a material at least two turns so that an each loop of the lace is overlapped and thereby a leading end and a trailing end of the lace are held fast to be tightened near the overlapping portion between at least one loop and the bound material.

A further object of the present invention is to provide a novel binding lace with which a binding operation is carried out with ease and the tightened condition is stabilized to meet the above objects.

Other objects of the present invention will be apparent from the following description, drawings and the claims.

DESCRIPTION OF THE PREFERRED EMBODIMENT

Figure 16:
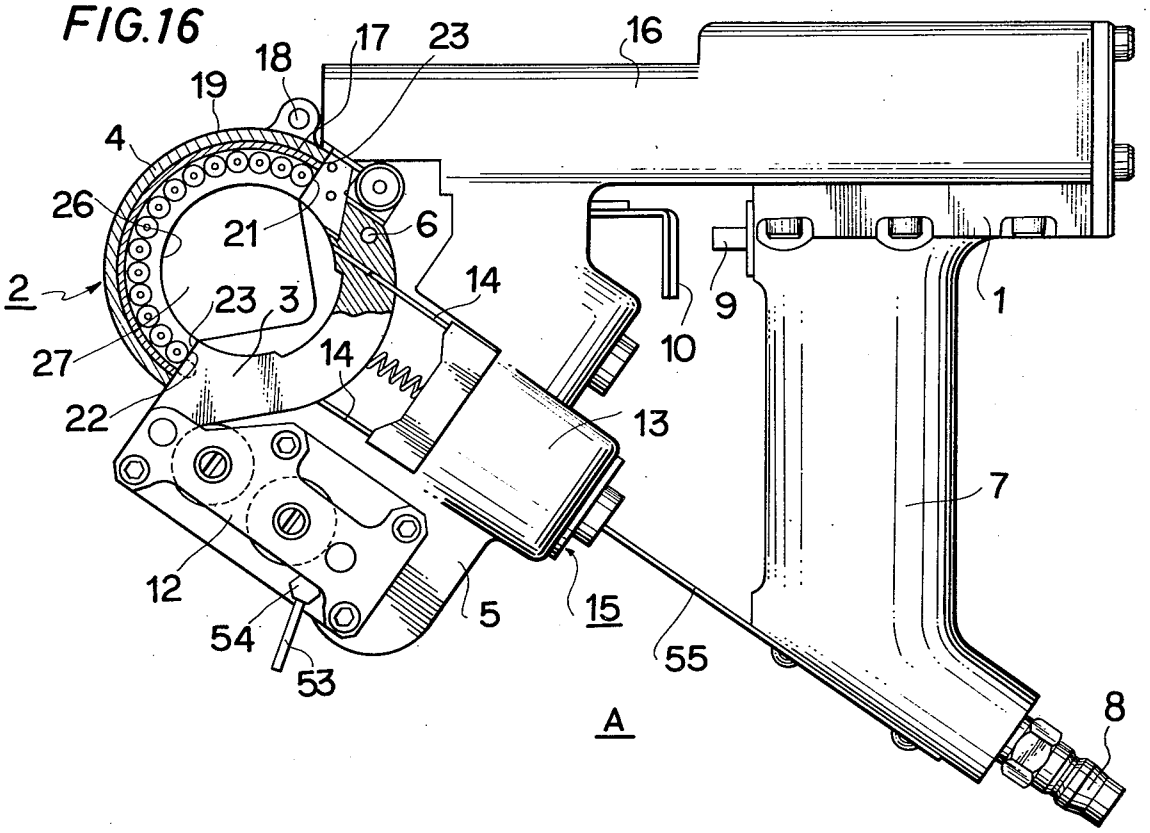
FIG. 16 is a front view, partly in cross section of the entire construction of a novel automatic binder.

The preferred embodiments of the binding lace according to the present invention will be described in more detail. First, an embodiment of the automatic binder through which a binding lace is utilized will be described with reference to FIGS. 16 to 18 in advance of a description of a binding lace, so that the spirit of the present invention will be understood with ease. In FIG. 16, a ring-shaped lace guide 2 is attached to the tip portion of a body 1 of the binder of a gun type. The lace guide 2 consists of a stationary guide element 3 and a movable guide element 4 in case of the embodiment illustrated in FIG. 16. The stationary guide element 3 is secured, through the medium of an attaching pin inserted in an attaching hole 6, to a supporting portion 5 depending from the tip portion of the body 1. The rear portion of the body 1 is formed with a grip portion 7 projecting downwards. The tail portion of the grip portion 7 is formed with an air plug 8, through which a working medium, such as air is introduced. A trigger valve stem 9 of a trigger valve projects from the side of the supporting portion 5 of the grip portion 7, while a trigger 10 is provided in opposing relation to the trigger valve stem 9 on the side of the supporting portion.

Formed on the lowermost portion of the supporting portion 5 but adjacent to the stationary guide element 4 is a feed-in, primary roller mechanism 12 which is adapted to feed a binding lace 11 of the present invention into the stationary guide element 4 from a lace source such as a reel (not shown). Positioned on the supporting portion 5 and provided adjacent to the roller mechanism 12 is a cutter mechanism 15 for cutting a binding lace 11 at the initial and terminal ends thereof, and the mechanism 15 consists of a cutter drive cylinder 13 and two cutters 14.

Positioned on an upper portion of the grip portion 7 on the body 1 is a secondary tightening, pneumatic cylinder 16 in projecting relation towards the movable guide element 3, and the pneumatic cylinder 16 is adapted to effect the secondary tightening of the binding lace 11. Provided on the tip portion of the secondary tightening pneumatic cylinder 16 is a lace gripping mechanism adapted to grip a tip portion 11*a* of a binding lace.

The movable guide element 4 is integral with a guide casing 19 which is rotatably supported at a root portion 17 thereof by the body 1 by means of a pin 18.

The stationary guide element 3 and the movable guide element 4 are coupled to each other by means of a connecting arm (not shown) disposed between the attaching hole 6 of the stationary guide 4 and the movable guide element 3. When the trigger 10 is pulled a drive shaft of the movable guide element 4 which is positioned adjacent to a root portion mating surface 21 is first drawn towards the stationary guide element 3 then rotated towards the same until the tip end mating portion 22 of the movable guide element 4 mates with the tip end mating portion 23 of the stationary guide element 3. The opening operation of the lace guide 2 is carried out by a force of a spring which biases the movable guide element 4 and is not shown.

Figure 17:
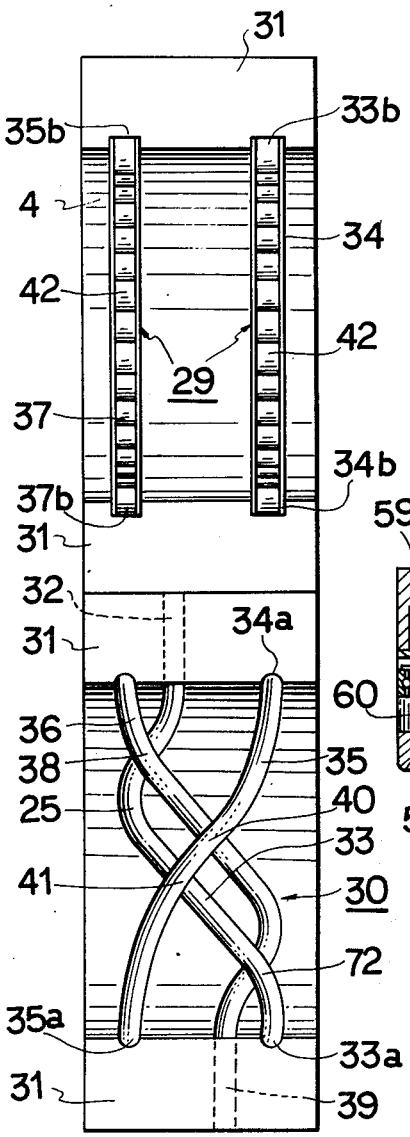
FIG. 17 is a developed front view illustrative of a lace guide by which a winding operation of an automatic binder is carried out.

Guide channels 28 are defined over the entire inner peripheral surface 26 of the lace guide 2. The guide channels 28 are adapted to guide the binding lace 11, which serves as a binding material for the material 64 to be bound, such as wires, around the outer periphery of the material 64. This material 64 is inserted into a central hole 27 provided in the lace guide 2. The guide channels 28 in lace guide 2, as shown in FIG. 17, are composed of parallel channel portions 29 defined in the movable guide element 4, and intersecting curved channel portions 30 defined in the stationary guide eledment 3. A lace lead-in hole 32 extends through a thickness-increased portion 31 of the stationary guide element 3 and is continuous with a first intersecting channel element 33. The first intersecting channel element 33 is formed with a curved portion 25 which projects to the left and runs to the right lower portion of the stationary guide element 3 and then from an end opening 33*a* to an end opening 33*b* in the movable guide element 4. The intersecting channel element 33 is continuous by way of the end openings 33*a*, 33*b* with the first parallel channel element 34 in the movable guide element 4. The first parallel channel element 34 is continuous by way of an end opening 34*b* with an end opening 34*a* in the second intersecting channel element 35 in the stationary guide element 3. The second intersecting channel element 35 runs aslant towards the left lower portion of the stationary guide element 3 as shown in FIG. 17, and intersects with a third intersecting channel element 36, and then with the first intersecting channel element 33. The second element 35 is in a deeper position than the first and third intersecting channel elements 33 and 36 at their intersections 40 and 41, while being continuous by way of an end openings 35*a*, 35*b*, with a second parallel channel element 37 in the movable guide element 4. The second parallel channel element 37 is continuous by way of an end opening 37*b* and an end opening 37*a* positioned in the left upper portion of the stationary guide element 3 with the third intersecting guide element 36. The third intersecting channel element 36 intersects with the first intersecting channel element 33 at 38 in a deeper position than the first intersecting channel element 33, and then the second intersecting channel element 35 at 40 in a less deeper position than the second intersecting channel element 35, and then with the first intersecting channel element 33 at 72 in a less deeper position than the first intersecting channel element 33, and is continuous with the lace lead-out hole 39.

In this manner, the guide channels 28 are defined in the movable guide element 4 and the stationary guide element 3 in such a manner that the first intersecting channel element 33 and the third intersecting channel element 36 are shallow, as compared with the second intersecting channel element 35 and thus discontinued at the first intersection 40 and the second intersection 41 of the intersecting channel elements 33 and 36. Accordingly, the curvature of the second intersecting channel element 35 in the direction to lead a lace outside, which curvature is associated with the depth of the channel, is increased in a range covering the first intersection 40 and the second intersection 41.

A plurality of feed rollers 42 are provided within the first parallel channel 34 and the second parallel channel 37 in the guide channels 28 and defined in the movable guide element 4, with the axes of the rollers 42 running at a right angle to the lead-out direction of the binding lace 11. The outer peripheral surfaces of feed rollers 42 are smooth and round as usual rollers, although the outer peripheral surface may be provided with feed guide channels so that the binding lace may travel without moving laterally.

Another embodiment of the automatic binder according to the invention has no feed rollers, either in the parallel channel 29 or the intersecting channel 30. In this case, the binding lace 11 is advanced by means of a vibration of the movable guide element 3.

On the other hand, an automatic binder which is provided with many feed rollers 42 in both the parallel channel 29 and intersecting channel 30 is also contemplated by the invention.

Figure 18:
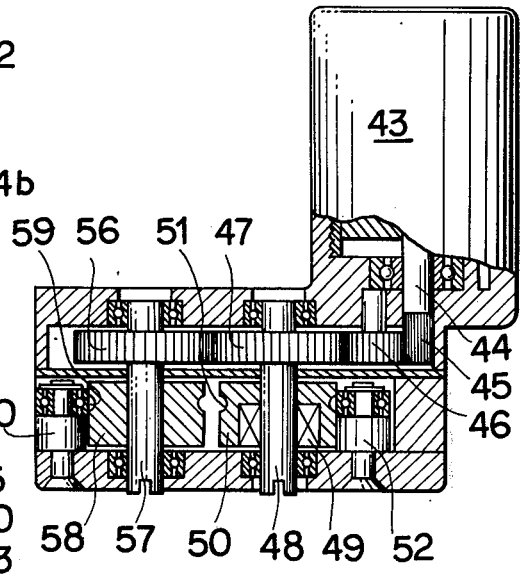
FIG. 18 is a cross sectional view, partly broken away, of a feed-in, primary tightening roller mechanism by which a feeding operation and primary tightening operation are carried out in an automatic binder.

A feed-in, primary tightening roller mechanism for feeding the binding lace into the stationary guide element 4 is shown in FIG. 18. A drive gear 45 is secured to the tip portion of a drive shaft 44 of a pneumatic motor 43, which is driven by compressed air. The pneumatic motor 43 permits rotation in the normal direction (in which the binding lace is fed into the stationary guide element 3, and so forth) as well as rotation in the reserse direction (in which the binding lace is tightened against the stationary guide element 4, and so forth.).

The drive gear 45 meshes through the medium of an intermediate deceleration pinion 46 with a first gear 47. The first gear 47 is integrally secured to a first roller shaft 48. A first roller 50 is secured through the medium of a one-way clutch 49 to the first roller shaft 48 in a manner to be free wheeling or fixed with respect to the first roller shaft 48. When the first roller 50 rotates in the normal direction, the first roller 50 is free wheeling, under the action of the one-way clutch 49, to rotate relative to the first roller shaft 48. In the reverse direction roller 50 is fixed with respect to shaft 48.

A guide channel 51 is defined in the outer peripheral surface of the first roller 50, thereby providing a space, through which a binding lace is to pass. The depth of the guide channel 51 is smaller in dimension than the diameter of the binding lace 11. A first-hold down roller 52 is positioned adjacent to the first roller 50. Between the first roller 50 and the first-hold down roler 52 there is mounted on the supporting portion 5 a lace lead-in pipe 53 by means of a pin 54 as shown in FIG. 16. The binding lace 11 is paid out from a reel not shown and via the lace lead-in pipe 53 inserted between the guide channel 51 and the first hold-down roller 52 in a manner that the binding lace 11 is somewhat squeezed together. The reel is positioned rotatably on a supporting plate 55 positioned between the grip portion 7 and the cutter mechanism 15. At this time, a resistance produced in the binding lace 11 against the aforesaid squeezing force caused a tension in the binding lace 11.

A second gear 56 is positioned in a manner to mesh with the first gear 47. The second gear 56 is secured to a second roller shaft 57, while a second roller 58 is also secured to the second roller shaft 57. A guide channel 59 is defined in an outer peripheral surface of the second roller 58, while a second hold-down roller 60 is positioned adjacent to the second roller 58. The depth of the guide channel 59 is the same as in the case of the guide channel 51.

A spacing between the first roller 50 and the second roller 58 is sufficiently large as compared with the diameter of the binding lace, so that the binding lace may pass between the first roller 50 and the second roller 58.

Positioned adjacent to the lace lead-out hole 39 of the stationary guide element 3 is a lace gripping means (not shown) and the tip portion of the binding lace 11 lead out from the lace lead-out hold 39 is gripped by the lace gripping means.

In order to feed the binding lace 11 into the stationary guide element 3 by means of the feed-in, primary tightening roller mechanism 12, the tip portion of the binding lace 11 is first led through the lace lead-in pipe 53, the guide channel 51 in the first roller 50 and the guide channel 59 in the second roller 58, then into the lace lead-in hole 32 beforehand, and then the pneumatic motor 43 is put into rotation in the normal direction. The rotation of the motor 43 in the normal direction causes the drive gear 45, intermediate deceleration pinion 46, first gear 47 and second gear 56 to rotate in the normal direction, so that a torque is transmitted to the second roller 58 to feed the binding lace 11 along the guide channels 28 in the lace guide 2. The first roller shaft 48 under action of the one-way clutch 49 cooperates with the first hold-down roller 52 to impart a resistance produced when the binding lace 11 is compressed, to the second roller 58 as a load to cause a tension in the binding lace 11. As a result, the binding lace 11 is not allowed to stand still between the rollers 50 and 58, and thus is smoothly fed into the stationary guide element 3 so as to travel along the guide channels 28, then out of the lace lead-out hole 39 to be gripped by means of the lace gripping means.

When the binding lace 11 is threaded around the bound material 64 to form loops therearound and then tightened, the pneumatic motor 43 reverses its rotation. The reverse rotation of the pneumatic motor 43 causes the reverse rotation in the second roller 58, while the first roller 50 causes the reverse rotation along with the first roller shaft 48 under the action of the one-way clutch 49. As a result, the binding lace 11 is tightened fast by means of two rollers 50 and 58, and thereby the contact area of the binding lace 11 with the rollers 50 and 58 is increased to make the tightening force large. In addition, even in case there is a slip between the second roller 58 and the binding lace 11 during the first tightening operation due to simultaneous rotation of the first roller 50 and the second roller 58, the first roller 50 may well compensate for a decrease in the tightening force arising from the aforesaid slip.

A pneumatic circuit for driving and controlling the above members is built in the automatic binder.

Figure 1:
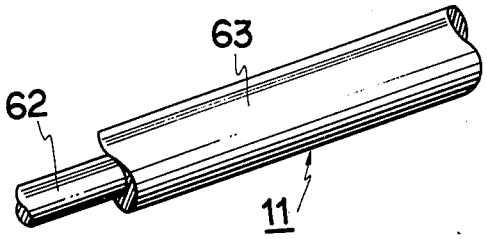
FIG. 1 is a front view of a binding lace which shows a preferred embodiment according to the present invention.
Figure 2:
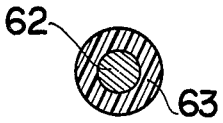
FIG. 2 is a cross sectional view of the binding lace.

FIGS. 1 and 2 show respectively a front view and a sectional view of the binding lace according to the present invention. The binding lace is formed in a double construction consisting of a core portion 62 and outer portion 63. The outer portion 63 is of high viscocity and elasticity as compared with the core portion 62, and may be prepared of vinyl chloride and the like.

On the other hand, the core portion 62 is of high rigidity and tensile strength as compared with the outer portion 63, and may be prepared of nylon and the like.

In view of the double-construction of the binding lace, the outer portion 63 is adapted easily to enlongate and contract as compared with the core portion 62 and yields a large contraction of the diameter of the outer portion 63 during the tightening operation and a sufficient recover of the large contraction of the diameter of the outer portion 63 after the cutting operation by means of the cutter 14. As a result, retaining of the tightened condition is remarkably improved. The binding lace 11 is rapidly fed along the guide channels 28 from the lace feed-in hole 32 into the lace feed-out hole 39 without buckling in case the binding lace 11 is pushed into the lace guide 2 by means of the feed-in, primary tightening roller mechanism 12 from only one side of the binding lace.

In addition, when the binding lace runs in the lace guide 2, the binding lace expands with elasticity outwardly in a radial direction of the lace guide 2 to keep the form of loops stable, and thereby the quantity of the binding lace 11 fed is always fixed by the feed-in, primary tightening roller mechanism 12.

When the binding lace 11 is tightened after the binding lace 11 feed is stopped, the diameters of the loops are gradually reduced so as to be wound around the material 64 to be bound, while the initial and terminal ends of the binding lace 11 are held between any one of the loops and the bound material 64. In this case, a strong tightening force which is imparted from the outside is sufficiently supported by a large tensile strength of the core portion 62, at this time the outside diameter of the binding lace 11 becomes gradually small due to an elongation of the binding lace 11.

On the other hand, the outside diameter of the binding lace 11 recovers due to the elasticity of the outer portion 63 after the external force is removed by cutting the initial and terminal ends of the binding lace 11 and then the outer portions 63 get twisted together so as to engage each other and each loop. Since the initial and terminal ends of the binding lace 11 are held fast between the loops and the bound object, the tightening force acting on the core portion 62 remains stable during a long time. In this manner, the large tensile strength in the core portion 62 and the engagement effect impart a multiplied stable tightening effect to the binding lace 11.

In the guide channels 28 in the lace guide 2, the binding lace 11 expands outwardly in a radial direction of the lace guide 2 due to the character of the core portion 62 and thereby the binding lace 11 is controlled by right and left surface and the outside surface thereof slidably to travel in the guide channels 28. Particularly at the cubic intersections 38, 40, 41 and 72, the binding lace 11 travels while contacting bottom portions of the intersections 33, 35 and 36 to form smoothly overlapping loops.

Figure 19:
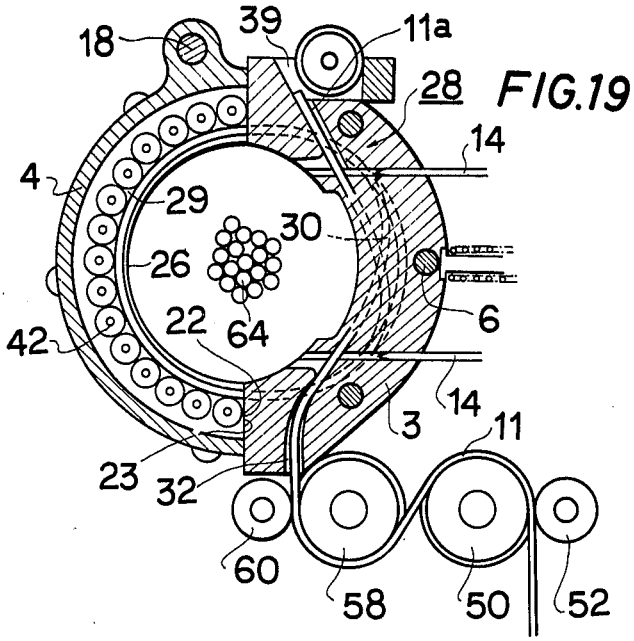
FIG. 19 is a view of an operating condition of a lace guide in case a binding lace runs along a lace guide.
Figure 20:
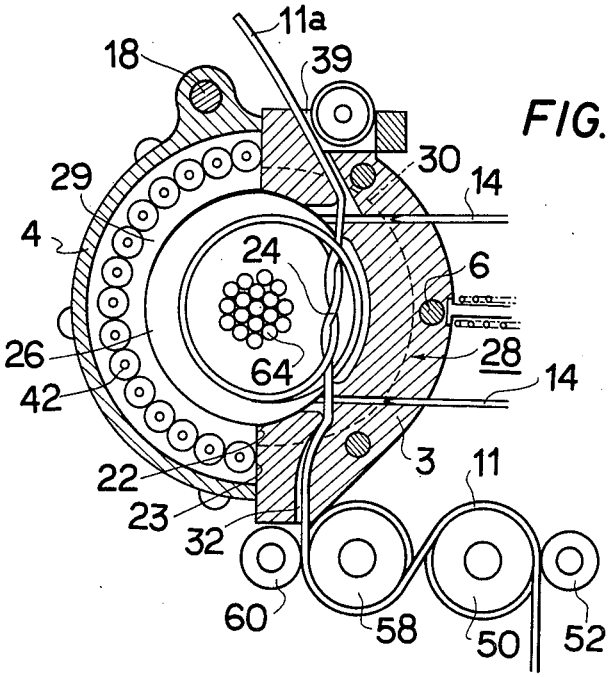
FIG. 20 is a view of an operating condition of a lace guide in case a binding lace is wound around a bound material and then partially tightened.
Figure 21:
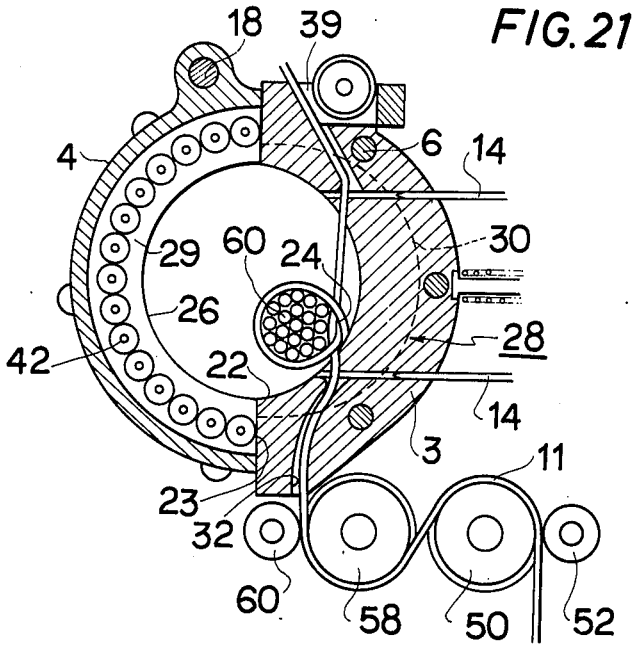
FIG. 21 is a view of an operating condition of a lace guide when a binding lace is fully tightened.
Figure 22:
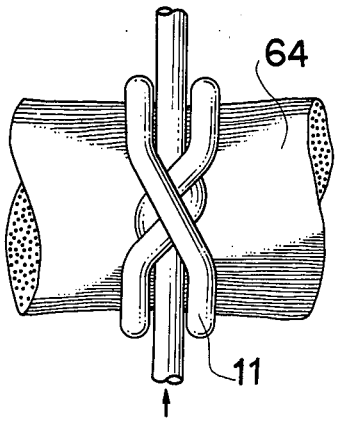
FIG. 22 is a front view showing the condition in which a bound material is tightened with a binding lace.

Next the movable guide element 4 is rotated toward the stationary guide element 3 to form the ring shape of the lace guide 2 as shown in FIG. 19. The lace guide 2 is thereby formed around the material 64, while the guide channels 28 open toward the internal wall of the lace guide, in other words, the material 64 in the lace guide 2. In this condition, when the pneumatic motor 43 is simultaneously rotated in the normal direction, the binding lace 11 which is beforehand settled in the form of semi-"S" is fed via the lace feed-in hole 32 into the lace guide 2, travels guided along the guide channels 28, until its tip portion 11*a* projects outside the lace guide 2 via the lace feed-out hole 39. The operational condition at this stage is shown in FIG. 19. In this condition in which the binding lace 11 is wound around the material 64, the gripping mechanism (not shown) grips tightly the tip portion 11*a* projecting from the lace feed-out hole 39, while the rollers 50 and 58 are stopped and reversed. The condition is illustrated in FIG. 20. Loop portions of the binding lace 11 which has been positioned in the guide channels 28 of the lace guide 2 are pulled outwardly in the opposing directions via the lace feed-in hole 32 and the lace feed-out hole 39. The diameters of the loop portions are gradually reduced and thereby the loop portions leave the guide channels 28 towards the central hole 27. The binding lace 11 is further tightened in opposite directions from the condition shown in FIG. 20 fast to be wound around the material 64 as shown in FIG. 21. The binding lace 11 somewhat changes the shape thereof to give a stable tightened condition because of the flexibility of the binding lace 11. After the binding lace 11 is bound tightly around the material 64 as shown in FIG. 21, the binding lace 11 is cut off by the cutter mechanism 15 in the projecting outward portion at a knot 24 and thereby the binding operation is completed. The lace guide 2 is then opened to permit the bound material 64 to be taken out.

In this manner, after the binding lace is fed according to the above process, a subsequent binding operation is possible. In this case, the stable binding operation without any trouble is allowed to be repeated with the binding lace according to the present invention.

In addition, the binding lace 11 is fed at a high rate so that the binding operation may be carried out efficiently by means of the automatic binder A.

On the other hand, even in the event of a low rate, the binding lace 11 is squeezed down by the first roller 50 and the first hold-down roller 52, the second roller 58 and the second hold-down roller 60 and fed into the lace feed-in hole 32 and then travels in the guide channels 28 sliding along both side walls and the bottom walls of the guide channels 28. Accordingly, static electricity is created on the binding lace 11 so as to charge the vicinity of the guide channels 28 and the binding lace 11, which is charged particularly at the feeding-in end with electricity.

Static electricity prevents the binding lace 11 from travelling and being freely fed into the lace feed-in hole 32. The above shortcoming is particularly disadvantageous in case the binding operation is repeated.

Under these circumstances an anti-static agent is coated at least on the outer surface of the binding lace 11, prepared from a plastic to form a membrane, or blended in the binding lace 11 during molding according to the other embodiments of the present invention so that easy travelling of the binding lace 11 is not prevented even due to sliding between the guide channels 28 and the binding lace 11. Thereby a lighter travelling may be given to the binding lace 11 even when a fresh binding lace 11 is always fed into the lace guide 2. In addition, it is necessary to build special anti-static mechanisms into the automatic binder A, so that the construction of the automatic binder 11 need not be complicated.

Figure 13:
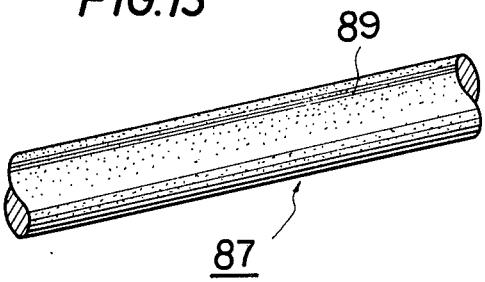
Figure 14:
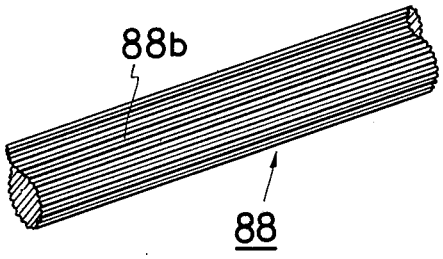
Figure 15:
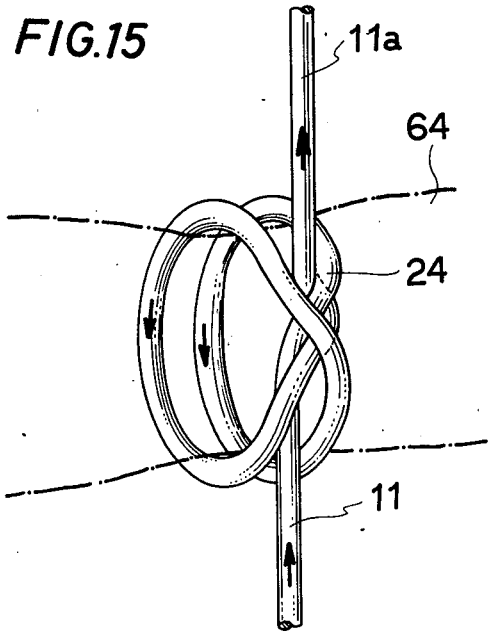
FIG. 15 is a perspective view illustrative of a condition in which the binding lace is wound around a material to form loops.

A binding lace 87 is shown in FIG. 13, which lace meets the above conditions and is circular in cross-section. The anti-static agent is coated on the outer surface of the outer portion 89. The anti-static agent may be blended in with the synthetic plastic matter forming the binding lace 87. In this case, coating of the surface of the outer portion 89 may be omitted. A binding lace 88 is shown in FIG. 14, an outer surface of which is coated or blended with an anti-static agent. The outer portion of the binding lace 88 is formed with many projecting ribs 88*b*. The anti-static agents may be listed as follows. There are anionic anti-static agents such as alkyl phosphate ester salts and sulfonated polystyrene triethanolamine salts, cationic electrification anti-static agents such as alkylamine derivatives, quaternary ammonium salts and dual ionic anti-static agents such as imidazoline metal salts and non-ionic anti-static agents such as polyoxyethylene aliphatic esters polyoxyethylene alkyl ethers.

Figure 3:
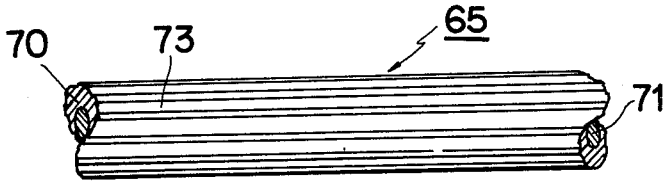
FIG. 3 is a front view of a binding lace which shows another embodiment according to the present invention.

FIG. 3 is a front view of another embodiment according to the present invention. The surface of an outer portion 70 is formed with many projecting ribs 73 along an a core portion 71. The many projecting lines 73 increase the elasticity of the outer portion 70 effectively to engage on each other in binding.

Figure 4:
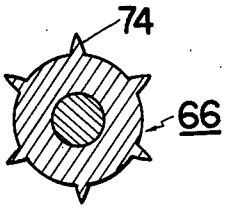
FIGS. 4 to 11 are cross sectional views of varied embodiments according to the present invention.
Figure 5:
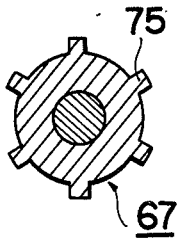
Figure 6:
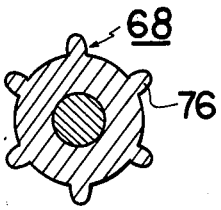

FIGS. 4 to 11 are cross-sectional views of binding laces formed with different projecting ribs. FIG. 4 shows a binding lace 66 which is formed with six sharp projecting ribs 74 distributed equally on the outer portion. FIG. 5 shows a binding lace 67 which is formed with six rectangular projecting ribs 75 spaced equally on the outer portion. FIG. 6 shows a binding lace 68 which is formed with six circular projecting ribs 76 distributed equally over outer portion. Of course, the number of projecting ribs must not be limitted to six.

Figure 7:
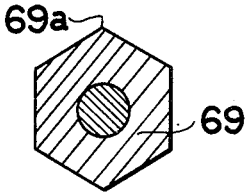

FIG. 7 shows a binding lace 69 having a hexagonal cross-section with six edge portions 69*a*. The projecting ribs 73 to 76 and the tip portion 69*a* of the binding laces 65 to 69 which are constructed in the above manner are squeezed, engaged or laid upon one another to be contacted at intersections the loops when binding the material 64. Thereby, the elasticity of the binding laces 65 to 69 prevents loosening of knots or slipping out of the binding laces 65 to 69.

Figure 8:
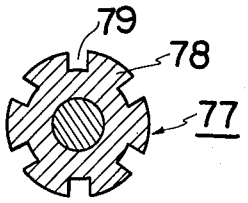
Figure 9:
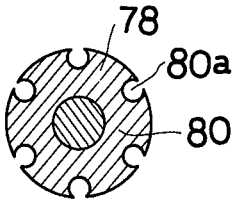

FIGS. 8 and 9 show other embodiments of binding laces 77 and 80.

The effect of the grooves 79 and 80*a* is the same as that of the projecting ribs 73 to 76 and the tip portion 69*a* of the binding laces 65 to 69.

Figure 10:
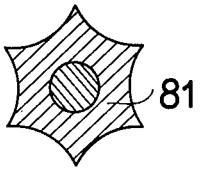

FIG. 10 shows a binding lace 81 which is formed with a star-shaped cross-section.

Figure 11:
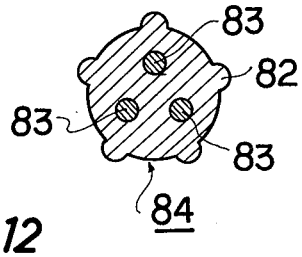

FIG. 11 shows a binding lace 84 which is formed with projecting ribs 82 of a semi-circular cross-section and with a core portion 83.

Figure 12:
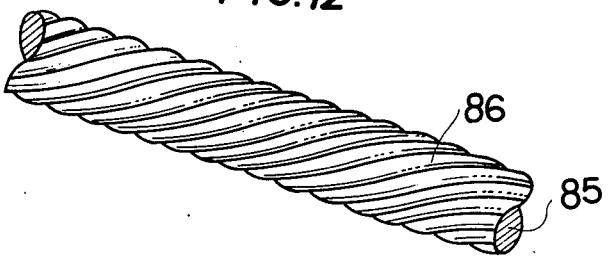
FIGS. 12 to 14 are perspective views of other embodiments according to the present invention.

FIG. 12 shows a binding lace 85 which is formed with an outer portion 86 spirally wound about a core of the binding lace 85. With the above outer portion 86 formed in the manner of a spiral, the force of friction is improved in binding.

The projecting ribs or grooves are continuously formed axially of the binding laces. These projecting ribs or grooves may also be formed intermittently axially of a binding lace.

Sectional shapes of the binding laces may be modified within the scope of the present invention to provide a balance between an outer tightening force and a holding force for maintaining the bound condition.

In addition, the core portion of the binding lace may be formed separate from the outer portion of the binding lace, so that the outer portion may somewhat slide with respect to the core portion.

Also, the core portion and the outer portion may be made of the same flexible material, such as a synthetic plastic material, which is provided with a sufficient tensile stress against the outer tightening force, because the elasticity of the outer portion may be affected by the physical form.

The outer portion of the binding lace shown in FIGS. 1, 3 and 4 to 12 may be coated with an anti-static preventing agent on the surface thereof, while the anti-static agent may be blended into the synthetic plastic which forms the binding lace.

We claim:

1. A binding lace for binding an object in a binder having a lace guide member with lace guide channels in the configuration of a knot and means for feeding said binding lace around said object by leading the free end thereof, winding said binding lace around said object, tightening the same after winding and cutting off the ends outside the knot after tightening, said lace comprising: a core portion made of nylon so as to have a relatively large rigidity sufficient to smoothly feed said binding lace into said guide channels without buckling of said free end and so as to have a relatively large tensile strength sufficient to effect tensile tightening of said lace around an object, and also having an outer layer completely surrounding said core portion and made of vinyl chloride so as to have sufficient elasticity to recover quickly from a reduction of the sectional area of the binding lace effected during the tightening of the lace and so as to have a relatively large viscoelasticity sufficient to prevent the surface of said outer layer from slipping and from loosening the knot after cutting.

2. A binding lace according to claim 1, wherein said outer layer has an anti-static agent blended thereinto.

3. A binding lace according to claim 1, wherein said outer layer has an anti-static agent coated thereon.

4. A binding lace according to claim 1, wherein said outer layer is provided with a plurality of ribs extending in the longitudinal direction of said lace.

5. A binding lace according to claim 1, wherein said outer layer is provided with a plurality of grooves extending in the longitudinal direction of said lace.

6. A binding lace according to claim 1, having a substantially hexagonal cross section, and wherein said core is substantially of circular cross section.

7. A binding lace according to claim 1, wherein said outer layer comprises a plurality of ribs extending helically around said core.

* * * * *